US007584568B1

(12) United States Patent
Brownlee

(10) Patent No.: US 7,584,568 B1
(45) Date of Patent: Sep. 8, 2009

(54) COLLAPSIBLE FIREARM SUPPORT

(76) Inventor: Walter L. Brownlee, 1110 First Ave. SE., Watertown, SD (US) 57201

( * ) Notice: Subject to any disclaimer, the term of this patent is extended or adjusted under 35 U.S.C. 154(b) by 0 days.

(21) Appl. No.: 11/649,556

(22) Filed: Jan. 4, 2007

(51) Int. Cl.
*F41C 27/00* (2006.01)

(52) U.S. Cl. ..... 42/94; 89/37.01

(58) Field of Classification Search ..... 42/94; 89/37.01
See application file for complete search history.

(56) References Cited

U.S. PATENT DOCUMENTS

| | | | | |
|---|---|---|---|---|
| 713,114 | A | | 11/1902 | La Force |
| 721,425 | A | | 2/1903 | Clyde |
| 1,184,078 | A | | 5/1916 | Cooke |
| 1,593,415 | A | | 7/1926 | Perkins |
| 1,786,308 | A | * | 12/1930 | Latourelle et al. ..... 248/155 |
| 2,498,749 | A | | 2/1950 | Benson |
| 2,826,848 | A | | 3/1958 | Davies |
| 2,844,905 | A | * | 7/1958 | Musser et al. ..... 42/94 |
| 3,233,517 | A | | 2/1966 | Morrison |
| 3,313,505 | A | * | 4/1967 | Petrie ..... 42/94 |
| 3,445,082 | A | * | 5/1969 | Frazer et al.. ..... 42/94 |
| 3,618,885 | A | | 11/1971 | Muller |
| 3,632,073 | A | | 1/1972 | Nakatani |
| 3,703,046 | A | * | 11/1972 | Barone et al. ..... 42/94 |
| 3,804,355 | A | | 4/1974 | Uroshevich |
| 4,010,922 | A | | 3/1977 | Heller et al. |
| 4,121,799 | A | | 10/1978 | Michio |
| 4,215,839 | A | | 8/1980 | Gibran |
| 4,265,045 | A | * | 5/1981 | Garbini ..... 42/94 |
| 4,317,552 | A | | 3/1982 | Weidler |
| 4,455,005 | A | | 6/1984 | Mooney |
| D276,621 | S | | 12/1984 | Hanke |
| 4,545,660 | A | | 10/1985 | Rudolf |
| 4,575,964 | A | | 3/1986 | Griffin |
| 4,580,483 | A | | 4/1986 | Garbini |
| 4,583,958 | A | | 4/1986 | Matsuda |
| 4,695,022 | A | | 9/1987 | Mendonsa et al. |
| 4,915,332 | A | | 4/1990 | Ouellette |
| 4,974,802 | A | | 12/1990 | Hendren |
| 5,029,407 | A | | 7/1991 | Kirkpatrick |
| 5,048,215 | A | | 9/1991 | Davis |
| 5,074,188 | A | | 12/1991 | Harris |
| 5,081,782 | A | | 1/1992 | Wright |
| 5,082,222 | A | | 1/1992 | Hsu |
| 5,142,806 | A | | 9/1992 | Swan |

(Continued)

*Primary Examiner*—Michael Carone
*Assistant Examiner*—Jonathan C Weber
(74) *Attorney, Agent, or Firm*—Jeffrey A. Proehl; Woods, Fuller, Shultz & Smith, P.C.

(57) ABSTRACT

A collapsible firearm support for supporting a firearm above a support surface is disclosed, and includes an elongate stanchion having an upper end and a lower end, a mount mounted on the stanchion and configured to mount to a firearm, and a leg assembly mounted on the stanchion. The leg assembly includes a plurality of legs, with each leg being pivotable between a stored position in which the leg is oriented substantially parallel to a longitudinal axis of the stanchion and a deployed position in which the leg is oriented at an angle to the longitudinal axis of the stanchion. The leg assembly is slidably movable with respect to the stanchion between the upper end and the lower end of the stanchion to adjust a vertical height of the upper end of the stanchion above a support surface when the leg assembly is rested on the support surface.

24 Claims, 10 Drawing Sheets

U.S. PATENT DOCUMENTS

| | | | | |
|---|---|---|---|---|
| D335,889 | S | 5/1993 | Gibran | |
| 5,310,145 | A | 5/1994 | Chen | |
| 5,345,706 | A | 9/1994 | Brown | |
| 5,354,024 | A | 10/1994 | Vinghog et al. | |
| 5,402,595 | A | 4/1995 | Tamllos | |
| 5,410,835 | A | 5/1995 | Vetter | |
| 5,417,002 | A | 5/1995 | Guerra | |
| 5,438,786 | A | 8/1995 | Hilderbrand | |
| 5,584,137 | A | 12/1996 | Teetzel | |
| 5,611,509 | A | 3/1997 | Kulp et al. | |
| 5,628,135 | A | 5/1997 | Cady | |
| 5,692,719 | A | 12/1997 | Shepherd | |
| 5,694,712 | A | 12/1997 | Plonka | |
| 5,713,553 | A | 2/1998 | Cooper | |
| 5,758,448 | A | 6/1998 | Thummel | |
| 5,806,228 | A | 9/1998 | Martel et al. | |
| 5,913,668 | A * | 6/1999 | Messer | 42/94 |
| 5,937,560 | A | 8/1999 | Beltz | |
| 5,946,842 | A | 9/1999 | Nyzell et al. | |
| 6,007,032 | A | 12/1999 | Kuo | |
| 6,055,760 | A | 5/2000 | Cuson et al. | |
| 6,192,908 | B1 | 2/2001 | Smith | |
| 6,283,421 | B1 | 9/2001 | Eason et al. | |
| 6,315,251 | B1 | 11/2001 | Stoudt et al. | |
| 6,315,256 | B1 | 11/2001 | Tolar | |
| 6,487,807 | B1 * | 12/2002 | Kopman et al. | 42/94 |
| 7,111,424 | B1 * | 9/2006 | Moody et al. | 42/72 |

* cited by examiner

COLLAPSIBLE FIREARM SUPPORT

BACKGROUND OF THE INVENTION

1. Field of the Invention

The present invention relates to firearm accessories and more particularly pertains to a new collapsible firearm support for supporting a firearm on a surface at a user-adjustable height.

2. Description of the Prior Art

The use of supports for firearms is generally known in the prior art. For example, the tripod gun handle disclosed in U.S. Pat. No. 6,487,807, of which I am a co-inventor, includes many useful features but lacks some features that could result in a more useful device. For example, the tripod gun handle described in the '807 patent does not allow for any significant height adjustment between the surface on which the tripod gun handle is rested and the gun that is being supported. The gun handle thus supports the gun at only one elevation above the surface, which does not provide the user with the ability to set the optimal height for the user's preferences and the particular conditions of use of the handle.

In these respects, the collapsible firearm support according to the present invention provides many of the features of the aforedescribed devices as well as providing additional features, such as height adjustment.

SUMMARY OF THE INVENTION

In view of the foregoing limitations in the known firearm accessories present in the prior art, the present invention provides a new collapsible firearm support wherein the same can be utilized for supporting a firearm on a surface at a user-adjustable height.

To attain this, the present invention generally comprises a collapsible firearm support for supporting a firearm above a support surface. The firearm support may comprise an elongate stanchion having an upper end and a lower end. The firearm support further includes a mount mounted on the stanchion and configured to mount to a firearm. The support further includes a leg assembly mounted on the stanchion, with the leg assembly including a plurality of legs, and each leg is pivotable between a stored position in which the leg is oriented substantially parallel to a longitudinal axis of the stanchion and a deployed position in which the leg is oriented at an angle to the longitudinal axis of the stanchion. The leg assembly is slidably movable with respect to the stanchion between the upper end and the lower end of the stanchion to adjust a vertical height of the upper end of the stanchion above a support surface when the leg assembly is rested on the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the capability to adjust the height that the collapsible firearm support supports the firearm above a surface with a positive locking structure, while permitting rotational movement and swivel movement of the firearm.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
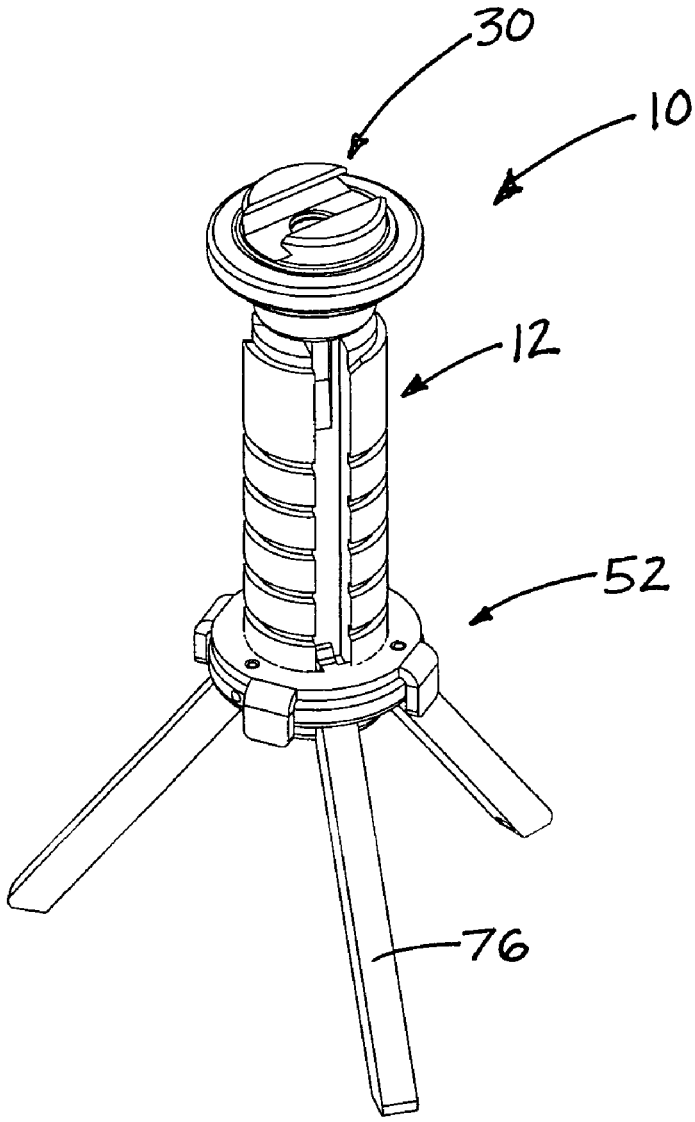
FIG. 1 is a schematic perspective view of a new collapsible firearm support according to the present invention.
Figure 2:
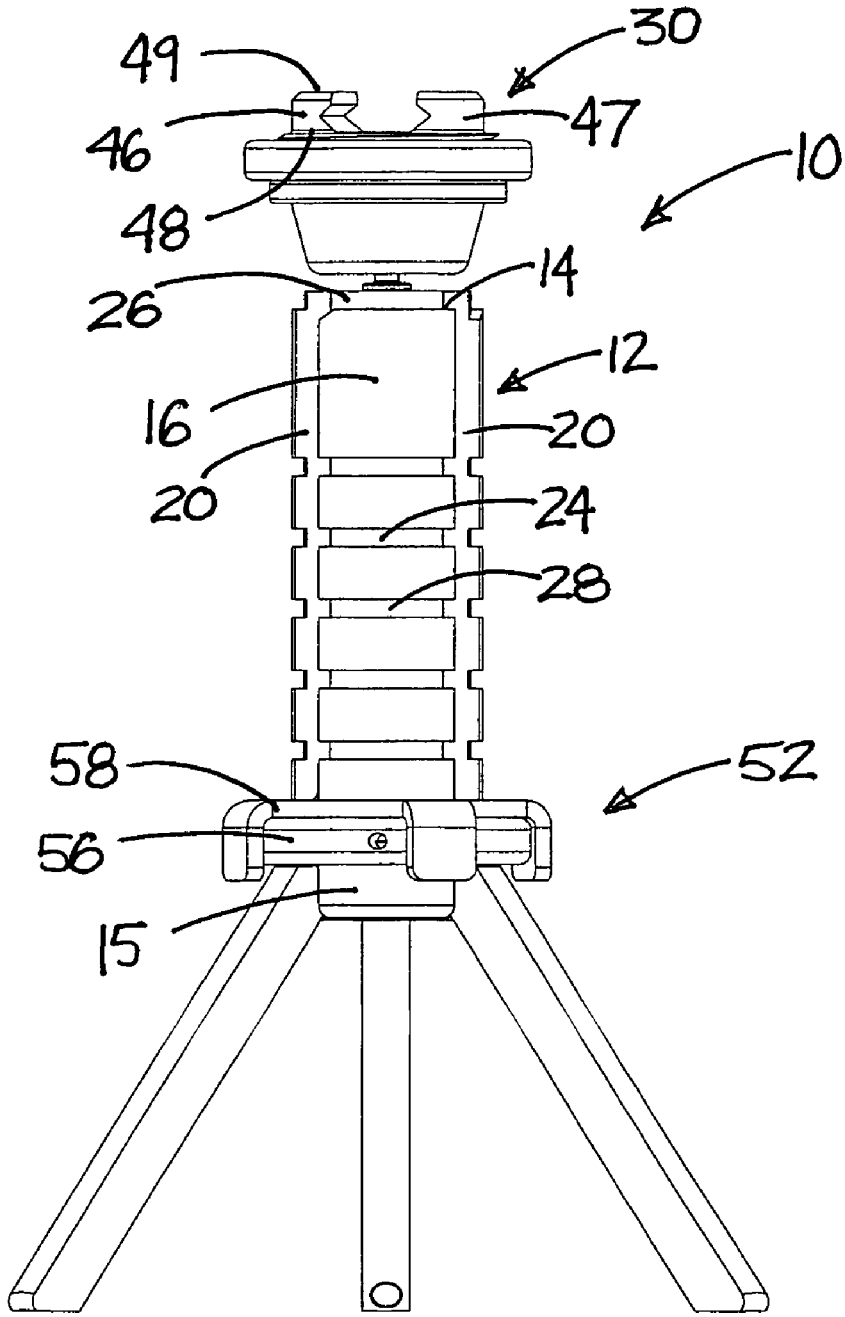
FIG. 2 is a schematic side view of the present invention.
Figure 3:
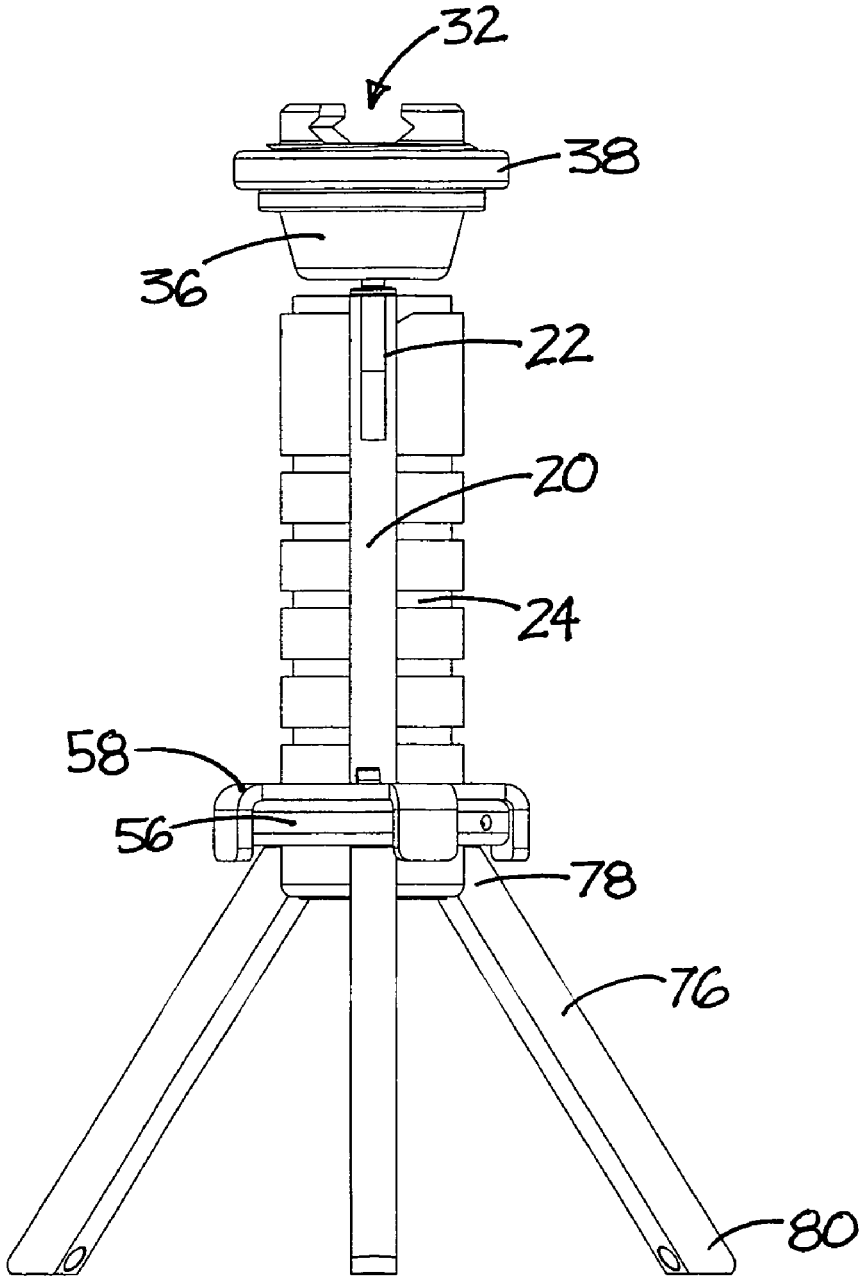
FIG. 3 is a schematic side view of the present invention shown rotated from the position in FIG. 2.
Figure 4:
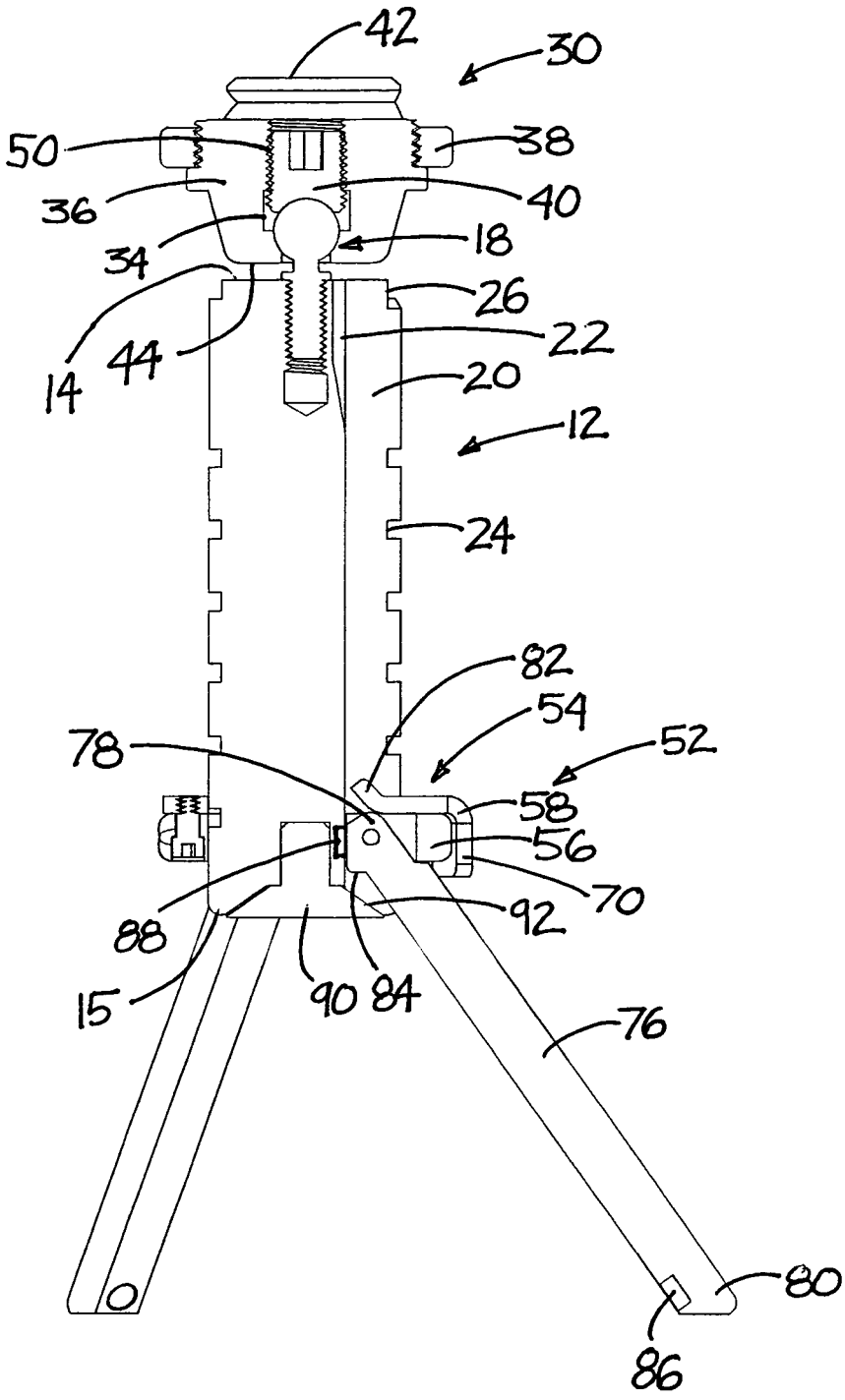
FIG. 4 is a schematic sectional view of the present invention with the section taken along a plane including a central longitudinal axis of the firearm support.
Figure 5:
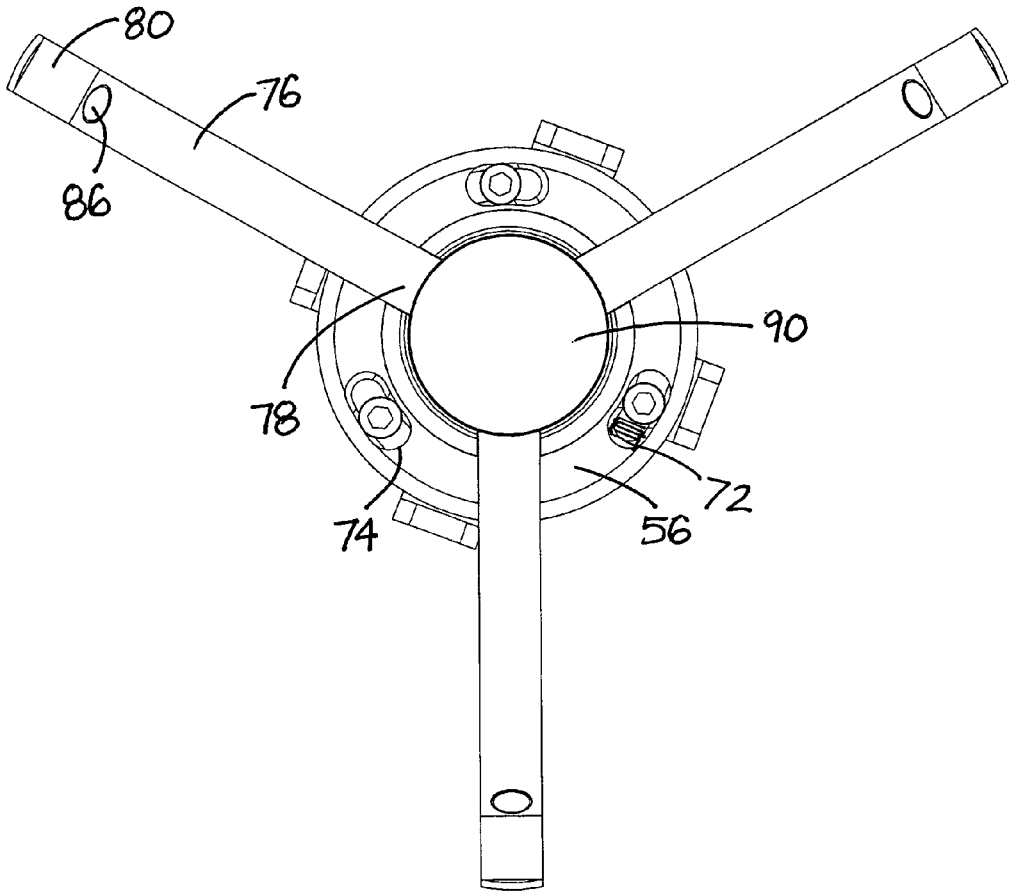
FIG. 5 is a schematic bottom view of the present invention.
Figure 6:
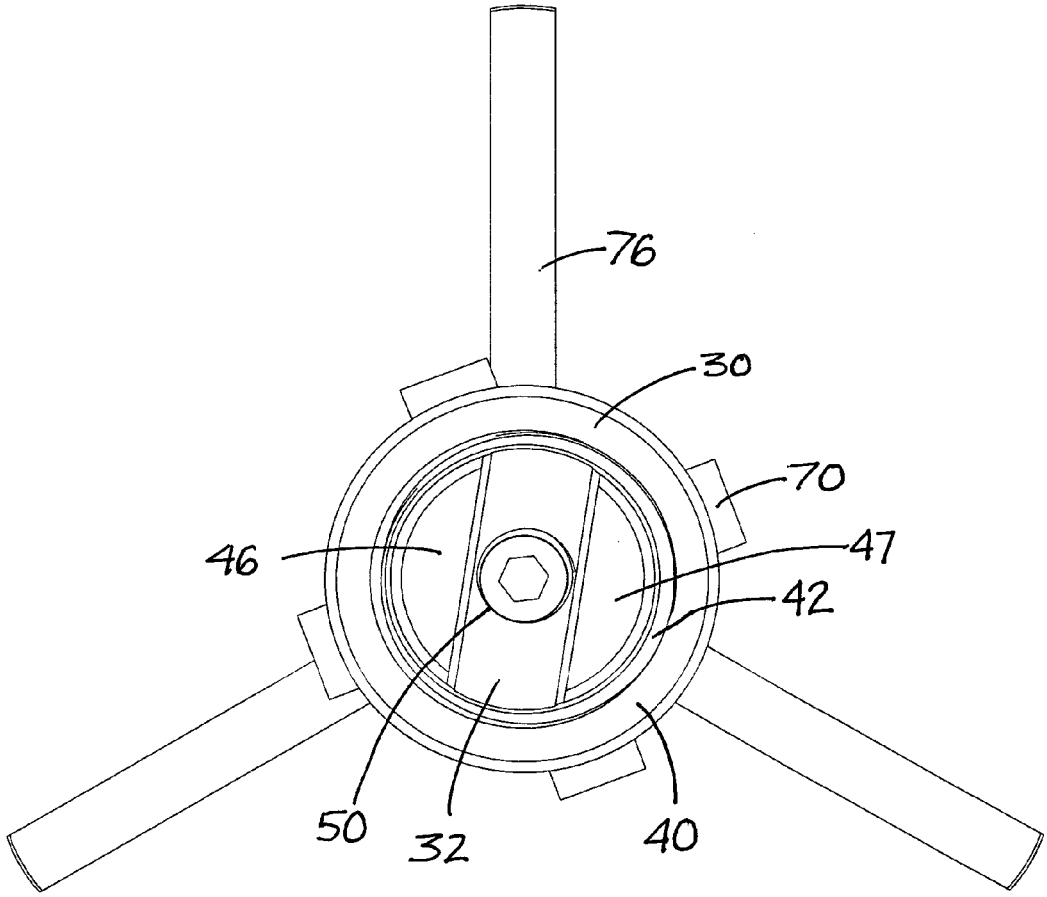
FIG. 6 is a schematic sectional view of the present invention with the section taken along a plane oriented perpendicular to the central longitudinal axis of the firearm support.

With reference now to the drawings, and in particular to FIGS. 1 through 10 thereof, a new collapsible firearm support embodying the principles and concepts of the present invention and generally designated by the reference numeral 10 will be described.

The collapsible firearm support 10 of the invention may generally include a stanchion 12, a mount 30 for mounting the stanchion 12 to the firearm, and a leg assembly 52 mounted on the stanchion.

In general, the leg assembly 52 is movable with respect to the stanchion 12, and the leg assembly is movable between a stored position (see FIG. 7) and a deployed position (see FIG. 1). The stored position of the leg assembly 52 is characterized by the legs 76 being positioned in a stored orientation with the legs nested in the guide grooves 20 and the deployed position of the leg assembly is characterized by the legs being positioned in a deployed orientation with the legs inclined outwardly from the stanchion 12. In the stored position of the leg assembly 52, the leg support 54 is positioned in the primary positioning groove 26 and in the deployed position, the leg support 54 is positioned in one of the secondary positioning grooves 28.

In greater detail, the stanchion 12 of the collapsible firearm support 10 may be elongate with an upper end 14 and a lower end 15, with an outer surface 16. For the purposes of this description, the terms "inward" and "inboard" will be used to refer to the direction toward the central longitudinal axis of the stanchion 12 and the terms "outward" and "outboard" will be used to refer to the direction away from the central longitudinal axis of the stanchion 12.

The stanchion 12 may include a swivel mount portion 18 for engaging the mount 30 which is further described below. The swivel mount portion 18 may be located toward the upper end 14 of the stanchion, and may have an outer surface at least a portion of which is substantially spherical.

The outer surface 16 of the stanchion 12 may be generally cylindrical, although this is not critical to the invention. The outer surface 16 of the stanchion 12 may also include at least one guide groove 20 that may extend substantially parallel to the longitudinal axis of the stanchion. The guide groove 20 may extend between the upper 14 and lower 15 ends of the stanchion. In some preferred embodiments of the invention, the outer surface 16 includes a plurality of the guide grooves 20. The plurality of guide grooves 20 generally corresponds to the number of legs 76 that are present on the firearm support 10, and illustratively includes three of the guide grooves (for a tripod lag arrangement) but may also include four or more grooves 20. The plural guide grooves 20 may be substantially uniformly spaced from each other about a perimeter of the outer surface 16 of the stanchion 12.

The outer surface 16 of the stanchion 12 may also include a deploying groove 22 that is positioned in at least one of, and preferably in all of, the guide grooves 20. The deploying groove 22 is located in an interior surface of the associated guide groove 20, and receives the deploying tab 84 of one of the legs 76, which is described below.

The outer surface 16 may also include at least one positioning groove 24, and illustratively includes a plurality of positioning grooves 24 that are spaced from each other along the length of the stanchion 12. The positioning groove 24 may comprise an annular groove that extends about the stanchion 12, although the positioning grooves may not be continuous about the stanchion, but may comprise, for example, a plurality of segments. The annular positioning groove 24, or the segments of the same positioning groove 24, may be located in a plane oriented substantially perpendicular to a longitudinal axis of the stanchion 12. The plurality of positioning grooves 24 may include a primary positioning groove 26 that is associated with the stored position of the leg assembly 52. The primary positioning groove 26 may be located toward or at the upper end 14 of the stanchion 12. The plurality of positioning grooves 24 may also include at least one secondary positioning groove 28 that is associated with the deployed position of the leg assembly 52. Each of the secondary positioning grooves 28 may be associated with a deployed position of the leg assembly 52 at a different height of the mount 30 above a surface on which the leg assembly is rested. The secondary positioning grooves may be located between the primary positioning groove 26 and the lower end 15 of the stanchion 12.

The mount 30 of the firearm support 10 is mounted on the stanchion 12, and may be rotatable with respect to the stanchion 12. The mount 30 may also be swivelable with respect to the stanchion 12. The mount 30 may be located on the upper end 14 of the stanchion 12. The mount 30 may define a receiver channel 32 for receiving the mounting structure 2 of the firearm 1. The rotation of the mount 30 with respect to the stanchion 12 provides adjustment of the orientation of the receiver channel 32 (and a firearm positioned thereon) with respect to the stanchion 12. The swivelability of the mount 30 with respect to the stanchion 12 provides swivelability of the stanchion 12 with respect to the firearm when the firearm is mounted on the receiver channel. The mount 30 may also define a cavity 34 that receives the swivel mount portion 18 of the stanchion 12.

The mount 30 of the firearm support 10 may comprise a mount assembly, and the mount assembly may comprise a primary member 36 that defines the cavity 34, an abutment ring 38 for selectively securing the firearm in the receiver channel 32, and a pressure member 40 for applying an adjustable amount of pressure on the swivel mount portion 18 of the stanchion located in the cavity 34. The primary member 36 has a top 42 and a bottom 44, and the cavity 34 is formed in the bottom 44 of the primary member. The receiver channel 32 is located on the top 42 of the primary member 36. Illustratively, the primary member 36 may include a pair of grip structures 46, 47 that are positioned in opposition to each other and spaced apart, with the receiver channel 32 being located between the grip structures. Each of the grip structures 46, 47 may have a base end 48 and a free end 49. The grip structures 46, 47 define a channel width therebetween. The channel width may be relatively larger at a central location between the respective free ends 48 and the respective base ends 49 than at the free ends 48 and the base ends 49.

The abutment ring 38 of the mount 30 may be configured to selectively apply pressure to a firearm positioned in the receiver channel 32 to resist sliding of the mount 30 with respect to the firearm. In the illustrative embodiment, the abutment ring 38 may be rotatably mounted on the primary member 36, although other manner for mounting the abutment ring on the primary member may be employed. The abutment ring 38 may include threads that engage threads formed on the outer surface of the primary member 36 such that rotation of the abutment ring in a first direction moves the abutment ring toward the receiver channel 32 and rotation of the abutment ring in a second direction moves the abutment ring away from the receiver channel.

The pressure member 40 of the mount 30 may be mounted on a passage 50 formed in the primary member 36. The pressure member 40 includes threads that engages threads formed on the passage of the primary member 36 such that rotation of the pressure member 40 in a first direction moves the pressure member toward the swivel mount portion 18 of the stanchion 12 and rotation of the pressure member in a second direction moves the pressure member away from the swivel mount portion of the stanchion.

Figure 7:
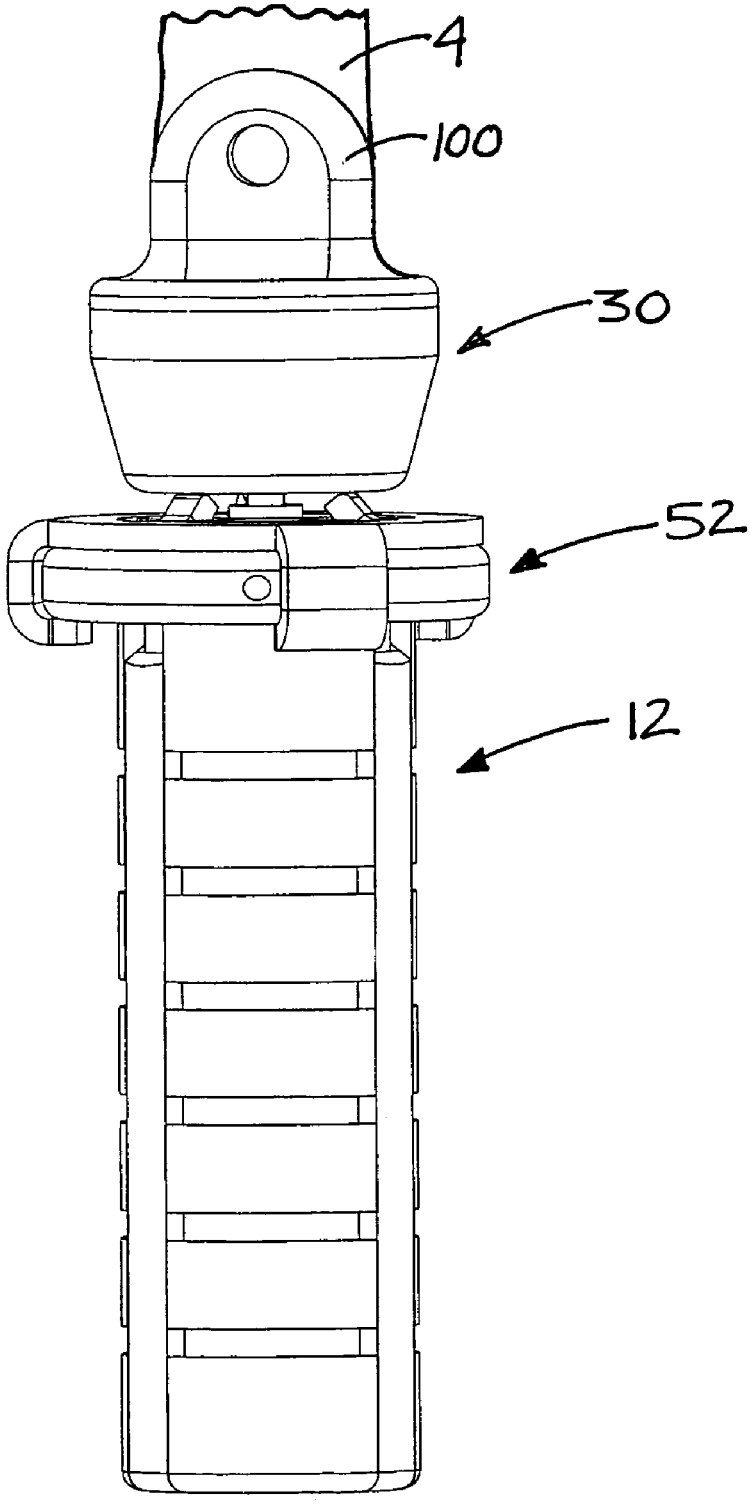
FIG. 7 is a schematic side view of the present invention showing the leg assembly in the stored position, and also showing an optional mount configuration.
Figure 8:
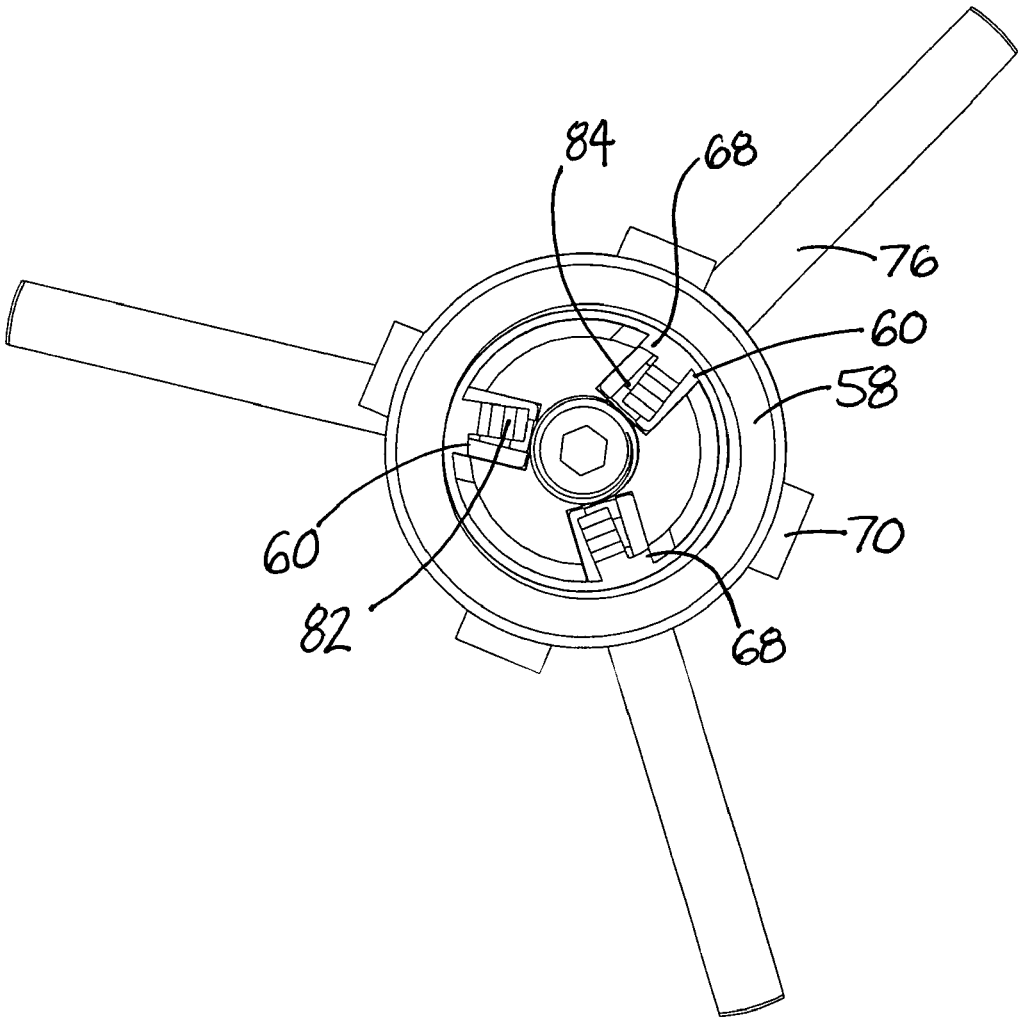
FIG. 8 is a schematic top view of the present invention shown with the mount removed to reveal detail of the stanchion and the leg assembly.
Figure 9:
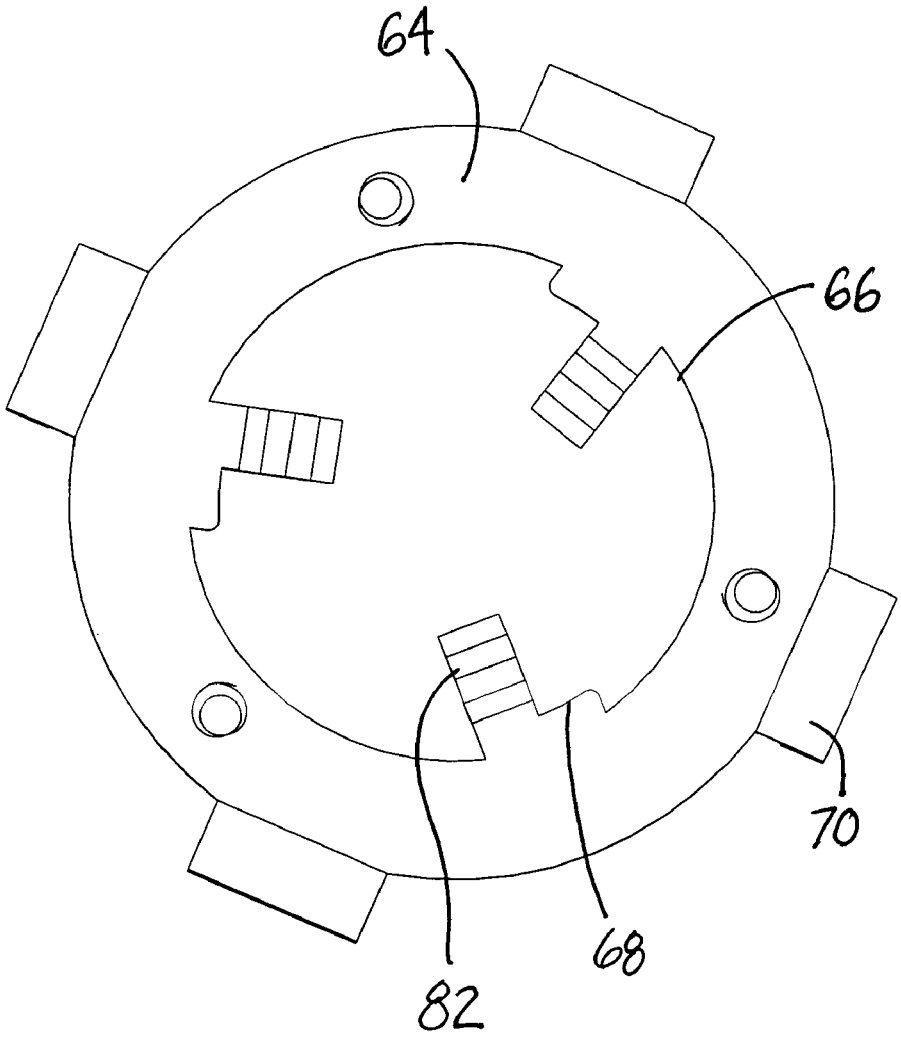
FIG. 9 is a schematic top view of the lock member isolated from other components of the present invention.
Figure 10:
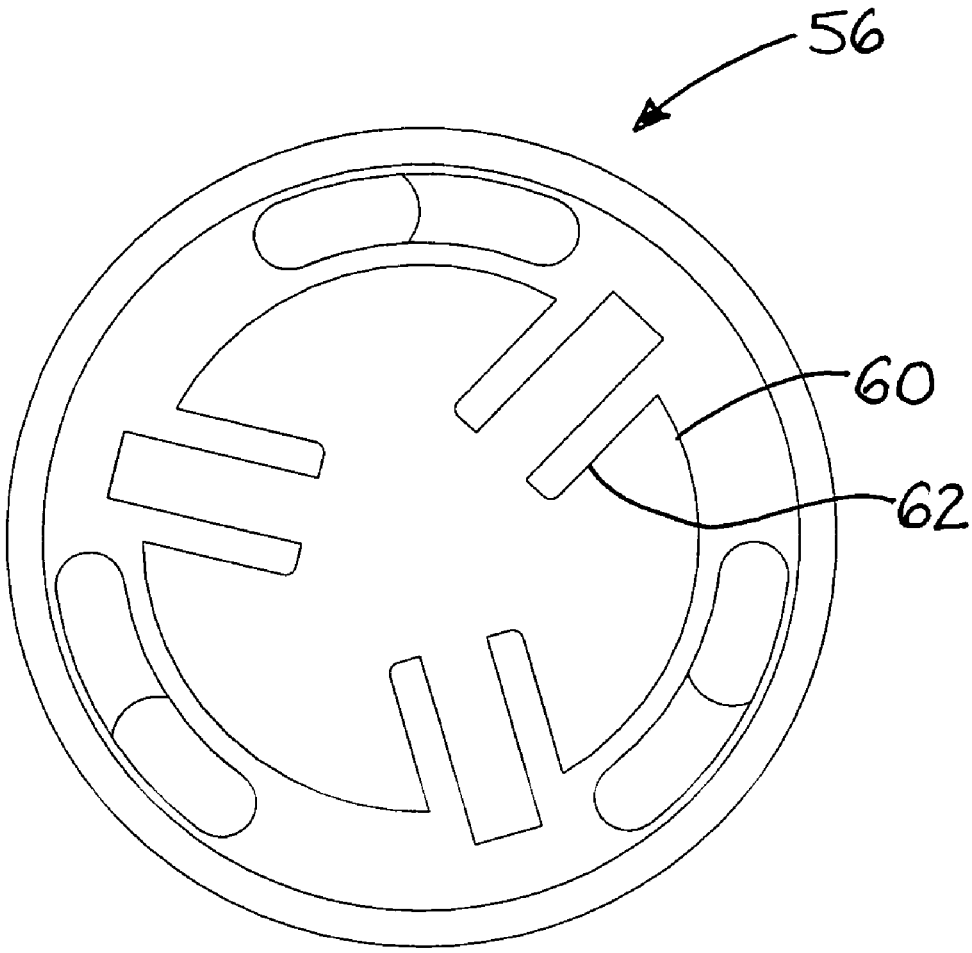
FIG. 10 is a schematic top view of the support member isolated from other components of the present invention.

Optionally, as shown in FIG. 7, the mount may comprise an upstanding ear 100 that connects to a mounting ear 4 of a firearm that is so equipped.

The leg assembly 52 of the firearm support 10 provides a support structure for the stanchion 12, and in turn the firearm when attached, that is movable with respect to the stanchion a stored position, in which the legs 76 are substantially retracted with respect to the stanchion, and a deployed position, in which the legs 76 extended with respect to the stanchion and may be splayed away from the stanchion. In the most preferred embodiments of the invention, the leg assembly 52 may be placed in the deployed position at least two degrees of extension of the leg assembly 52, to thereby set the height of the supported position of the firearm.

In greater detail, the leg assembly 52 may comprise a leg support 54, and the leg support may be movable along at least a portion of the stanchion 12. The leg support 54 may be slidable along at least a portion of the length of the stanchion 12 between the upper 14 and lower 15 ends. The leg support 54 may comprise a support member 56 and a lock member 58. The support member 56 may define an aperture 60 that receives a portion of the stanchion 12, and permits sliding of the support member with respect to the stanchion. The support member 56 may include a guide tab 62 that extends into the aperture 60, and further extends into the guide groove 20 of the stanchion 12 to resist rotation of the support member with respect to the stanchion. In some embodiments, the number of guide tabs 62 that are mounted on the support member 56 corresponds to the number of guide grooves 20 that are formed on the stanchion 12, so that a guide tab of the support member 56 is positioned in each of the guide grooves.

The lock member 58 is provided for releasably locking the support member 56 in a selected position on the stanchion 12. The lock member 58 may be mounted on the support member 56, and may be rotatable with respect to the support member. The lock member 58 may have a locking position (see FIG. 7) and a releasing position. The lock member 58 may be rotated with respect to the support member 56 between the locking position and the releasing position. Illustratively, the lock member 58 may be positioned above the support member 56. The lock member 58 may comprise a body portion 64 which may define an aperture 66 that receives a portion of the stanchion 12. The lock member 58 may further comprise a lock tab portion 68 for engaging one of the positioning grooves on the stanchion 12. The lock tab portion 68 may be located on the body portion 64. The lock tab portion 68 may extend inwardly from the body portion 64, and may extend into the aperture 66 defined by the body portion. In some embodiments, the number of lock tab portions 68 that are mounted on the body portion 64 corresponds to the number of guide grooves 60 that are formed on the stanchion 12, so that a lock tab portion of the lock member 58 is positioned in each of the guide grooves for selectively engaging one of the positioning grooves.

The lock member 58 may further comprise a positioning tab portion 70 for positioning the lock member 58 with respect to the support member 56. The positioning tab portion 70 may extend outwardly from the body portion 64, and may further extend downwardly with respect to the body portion, so that the positioning tab portion 70 is positioned adjacent to the support member 56. The lock member 58 may include two or more positioning tab portions 70 which are spaced about the outer perimeter of the body portion to position the lock member 58 with respect to the support member such that the aperture 60 and the aperture 66 are substantially axially aligned.

As a preferred option, the lock member 58 may feature one or more abutting tabs 82 for holding the mount 30 in a position when the leg assembly 52 is in the stored position and the leg 76 is in the retracted position. The abutting tabs 82 may each extend into one of the guide grooves 20 of the stanchion 12 from the lock member 58, and may thus extend inwardly from the body portion 64 into the aperture 66 in the body member The abutting tab 82 may extend beyond the upper end 14 of the stanchion 12 when the leg 76 is in the retracted position, so that the tab or tabs 82 contact the bottom 44 of the mount 30 and thereby restrict swivel movement of the mount.

The leg assembly 52 may further comprise structure for biasing the lock member 58 into the locking position and the lock tab portions 68 into engagement with one of the positioning grooves 24. The biasing structure may comprise a spring 72 that bears or presses against the support member 56 and the lock member 58. The spring 72 may bear against a structure mounted on the lock member 58, such as, for example, a screw that is mounted on the lock member 58 and moves in a slot 74 formed in the support member 56.

The leg assembly 52 further includes a plurality of legs 76 that are mounted on the leg support 54. The plurality of legs 76 may be pivotable with respect to the leg support 54. Each of the legs may have an inboard end 78 and an outboard end 80, and the inboard end 78 may be pivotally mounted on the support member 56. The legs 76 may be movable between a stored orientation (see, for example, FIG. 7) and a deployed orientation (see, for example, FIG. 1).

Each leg 76 may also include a deploying tab 84 for deploying the leg 76 when the leg assembly 52 is moved from the stored position to the deployed position. The deploying tab 84 may be located on an inward surface of the leg 76, and may extend into the deploying groove 22 in the stanchion 12 when the leg is in the retracted position. The length of the deploying groove 22 may be such that any significant movement of the leg assembly 52 from the stored position toward the deployed position causes the deploying tab 84 to move out of the deploying groove 22 to thereby pivot the leg 76 with respect to the leg support 54. In the illustrative embodiment, the deploying groove 22 tapers shallower toward the lower end 15 of the stanchion, so that the deploying tab 84 is accommodated in the deploying groove 22 when the leg assembly 54 is in the stored position, but is forced outwardly as the leg assembly is moved toward the lower end 15 of the stanchion and the deploying groove becomes shallower.

The leg assembly 52 may include a retainer magnet 86 on each leg 76. The retainer magnet 86 may be positioned on an inward surface of the leg 76, and may be positioned adjacent to a magnetically receptive material 88 mounted on the stanchion 12 when the leg 76 is in the retracted position. The magnet 86 may thus function to provide a biasing force for biasing the leg 76 toward the retracted position.

It will be noted that in some embodiments of the invention, each of the legs 76 is at least partially nestable in one of the guide grooves 20 of the stanchion 12, and preferably the legs are each substantially fully nestable in the guide groove.

The firearm support 10 may further include a deploying structure 90 for moving the legs 76 toward the deployed orientation when the leg assembly 52 is moved from the stored position toward the deployed position. The deploying structure 90 may be mounted on the stanchion 12, and may be positioned toward the lower end 15 of the stanchion 12. The deploying structure 90 may have an inclined surface 92. The inclined surface 92 may be inclined with respect to the central longitudinal axis of the stanchion 12. The inclined surface may be in communication with each of the guide grooves 20 of the stanchion 12.

In use, the user of the collapsible firearm support 10 may engage the support 10 in the collapsed condition by grasping the stanchion 12 or the mount 30 with one hand, and grasping the leg assembly 52 with the other hand, and the leg assembly may be rotated slightly to move the lock tab 68 of the lock member 58 out of primary positioning groove 24 and against the pressure of the spring 72. The leg assembly 52 is then slid on the stanchion 12 toward the lower end 15 of the stanchion.

The deploying tab 84 on the each of the legs 76, which are initially positioned in the deploying groove 22, are forced out of the deploying groove by the movement of the leg assembly 52 relative to the stanchion 12. The leg assembly 52 is moved along the stanchion 12 until the effective length of the stanchion and the leg assembly is at the desired height, and the nearest secondary positioning groove 28 is selected. The rotating force applied by the hand on the lock member 58 may be released so that the spring biases the lock tab 68 into the selected positioning groove 28. Movement of the lack tab 68 into the positioning groove serves to resist movement of the leg assembly 52 with respect to the stanchion 12 until further rotational force is applied to the lag assembly and the lock member that releases the lock tab from the positioning groove.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible firearm support for supporting a firearm above a support surface, the firearm support comprising:

an elongate stanchion having an upper end and a lower end, the stanchion having an outer surface;

a mount mounted on the stanchion and configured to mount to a firearm; and a leg assembly mounted on the stanchion, the leg assembly including a plurality of legs, each leg being pivotable between a stored position in which the leg is oriented substantially parallel to a longitudinal axis of the stanchion and a deployed position in which the leg is oriented at an angle to the longitudinal axis of the stanchion;

wherein the leg assembly is slidably movable with respect to the stanchion along at least a portion of the outer surface between the upper end and the lower end of the stanchion to adjust a vertical height of the upper end of the stanchion above a support surface when the leg assembly is rested on the support surface;

wherein the stanchion includes a plurality of guide groove extending into the outer surface of the stanchion, each of the guide groove extending along the outer surface in an orientation substantially parallel to a longitudinal axis of the stanchion;

wherein each of the legs members is pivotable about a respective pivot on the leg assembly between a stored position and a deployed position each of the pivots of the legs members being slidable in one of the plurality of guide grooves.

2. The firearm support of claim 1 wherein the leg assembly is positionable and securable at least two discrete positions along the outer surface between the upper and lower ends of the stanchion.

3. The firearm support of claim 1 wherein the leg assembly is positionable and securable at least three discrete positions between the upper and lower ends of the stanchion.

4. The firearm support of claim 1 wherein a tab portion of the leg assembly extends into the one of the plurality of guide grooves such that sliding movement of the leg assembly is guided by the guide groove.

5. The firearm support of claim 4 wherein the stanchion includes at least two positioning grooves being positioned on the outer surface of the stanchion, each of the at least two positioning grooves being in communication with at least one of the plurality of guide grooves such that the tab portion of the leg assembly is selectively movable from the guide groove into the at least one positioning groove to lock the leg assembly at a discrete position on the stanchion corresponding to the positioning groove in which the tab portion is positioned.

6. The firearm support of claim 5 wherein the at least two positioning grooves extend about the stanchion and lies in a plane oriented substantially perpendicular to a longitudinal axis of the stanchion and substantially perpendicular to an axis of the at least one of the plurality of guide grooves.

7. The firearm support of claim 5 wherein each of the at least two positioning grooves are located at discrete and different positions along a length of the stanchion to provide a discrete and different position of the leg assembly on the stanchion.

8. The firearm support of claim 5 wherein the at least two positioning grooves includes:

a primary positioning groove associated with a stored position of the leg assembly; and at least one secondary positioning groove associated with a deployed position of the leg assembly;

wherein the stored position and the deployed position are different positions.

9. The firearm support of claim 1 wherein the mount is rotatable with respect to the stanchion.

10. The firearm support of claim 1 wherein the mount is swivelable with respect to the stanchion.

11. The firearm support of claim 1 wherein the mount comprises a mount assembly including:

a primary member having a receiver channel formed therein for receiving a mounting portion of the firearm; and:

an abutment ring for selectively securing the firearm in the receiver channel, the abutment ring being configured to selectively apply pressure to the mounting portion of a firearm positioned in the receiver channel to resist sliding of the mount with respect to the firearm.

12. The firearm support of claim 11 wherein the abutment ring is rotatably mounted on the primary member and has an annular contact surface, the abutment ring including threads engaging threads formed on the primary member such that rotation of the abutment ring in a first direction moves the annular contact surface of the abutment ring toward the receiver channel and rotation of the abutment ring in a second direction moves the annular contact surface of the abutment ring away from the receiver channel.

13. The firearm support of claim 1 wherein the mount comprises a mount assembly including a primary member having a receiver channel formed therein for receiving a mounting portion of the firearm; and wherein the primary member forms a cavity receiving a swivel mount portion of the stanchion at the upper end thereof, at least a portion of an exterior of the swivel mount portion of the stanchion being substantially spherical.

14. The firearm support of claim 1 wherein the leg assembly comprises:

a leg support slidably movable along at least a portion of the outer surface of the stanchion, the plurality of legs being pivotably mounted on the leg support such that the legs are pivotable with respect to the leg support and the stanchion.

15. The firearm support of claim 14 wherein at least one of the legs has an abutting tab located on the inboard end of the leg for holding the mount in a position when the leg is in a retracted position.

16. The firearm support of claim 14 additionally comprising a deploying structure mounted on the stanchion for moving the legs of the leg assembly toward a deployed orientation when the leg assembly is moved from a stored position toward a deployed position.

17. The firearm support of claim 1 wherein the leg support comprises:

a support member defining an aperture receiving a portion of the stanchion; and a lock member configured to engage the outer surface of the stanchion to releaseably lock the support member in a position along the stanchion, the lock member being mounted on the support member.

18. The firearm support of claim 17 wherein the lock member is rotatable with respect to the support member, the lock member having a locking position and a releasing position.

19. The firearm support of claim 17 additionally comprising biasing means for biasing the lock member into the locking position with respect to the support member.

20. The firearm support of claim 17 wherein the lock member comprises:

a body portion defining an aperture receiving a portion of the stanchion; and a lock tab portion for engaging a positioning groove on the stanchion.

21. The firearm support of claim 1 wherein at least one leg being at least partially nestable in the at least one guide groove of the stanchion.

22. The firearm support of claim 1 wherein the stanchion includes a deploying groove positioned in at least one of the guide grooves, the deploying groove being located in a interior surface of the associated guide groove; and a deploying tab located on the leg and positioned to engage the deploying groove and the at least one guide groove such that the deploying tab pivots the leg outwardly from the outer surface of the stanchion when the leg assembly is moved along the outer surface of the stanchion from the stored position to the deployed position, the deploying tab being located on an inward surface of the leg.

23. A collapsible firearm support for supporting a firearm above a support surface, the firearm support comprising:

an elongate stanchion having an upper end and a lower end, the stanchion having an outer surface;

a mount mounted on the stanchion and configured to mount to a firearm; and a leg assembly mounted on the stanchion, the leg assembly including a plurality of legs, each leg being pivotable between a stored position in which the leg is oriented substantially parallel to a longitudinal axis of the stanchion and a deployed position in which the leg is oriented at an angle to the longitudinal axis of the stanchion;

wherein the leg assembly is slidably movable with respect to the stanchion along at least a portion of the outer surface between the upper end and the lower end of the stanchion to adjust a vertical height of the upper end of the stanchion above a support surface when the leg assembly is rested on the support surface;

wherein the leg assembly includes a locking tab movable with the leg assembly along the stanchion;

wherein the outer surface of the stanchion defines at least one guide groove, the at least one guide groove extending along an axis that is oriented substantially parallel to a longitudinal axis of the stanchion, the locking tab of the leg assembly extending into the at least one guide groove such that sliding movement of the leg assembly with respect to the stanchion moves the locking tab in the at least one guide groove;

wherein the outer surface of the stanchion defines at least two positioning grooves, each of the at least two positioning grooves extending substantially perpendicular to the axis of the at least one guide groove;

wherein each of the at least two positioning grooves is in communication with the at least one guide groove such that the locking tab is movable from the guide groove into each of the positioning grooves to lock a position of the leg assembly with respect to the stanchion.

24. The firearm support of claim 23 wherein the locking tab must be moved out of all of the positioning grooves in order to slidably move the leg assembly along the stanchion.

* * * * *